US005458552A

United States Patent [19]

Mara

[11] Patent Number: 5,458,552

[45] Date of Patent: Oct. 17, 1995

[54] MARTIAL ARTS FOCUS TARGET APPARATUS

[76] Inventor: Scott G. Mara, 40 Saddle Ridge Rd., Milton, Mass. 02186

[21] Appl. No.: 219,105

[22] Filed: Mar. 28, 1994

Related U.S. Application Data

[63] Continuation-in-part of Ser. No. 9,674, Jun. 17, 1993, Pat. No. Des. 356,127.

[51] Int. Cl.[6] ..... A63B 26/00

[52] U.S. Cl. ..... 482/90; 482/87; 482/83

[58] Field of Search ..... 482/83–87; 269/244, 269/101; 248/316.6, 231.6

[56] References Cited

U.S. PATENT DOCUMENTS

| | | | |
|---|---|---|---|
| 944,648 | 12/1909 | Austin | 482/86 |
| 2,792,581 | 5/1957 | Woyton | 248/231.6 |
| 3,813,095 | 5/1974 | Long | 482/87 |
| 4,270,724 | 6/1981 | McMullen | 248/231.6 |
| 4,913,419 | 4/1990 | McAuliffe | 482/87 |
| 5,183,451 | 2/1993 | Hautomaki | 482/83 |
| 5,277,679 | 1/1994 | Wells | 482/83 |
| 5,352,170 | 10/1994 | Condo et al. | 482/83 |

*Primary Examiner*—Jerome Donnolly
*Attorney, Agent, or Firm*—Richard P. Crowley

[57] ABSTRACT

A martial arts focus target apparatus for the practice of martial arts techniques and procedures. The apparatus includes a base, a post extending upright from the base and one or more flexible focus target pads having a free extended one end and releasably secured at the other end by a locking member to the post at selected heights, sides and angles.

14 Claims, 3 Drawing Sheets

MARTIAL ARTS FOCUS TARGET APPARATUS

REFERENCE TO PRIOR APPLICATION

This application is a continuation-in-part application of U.S. Ser. No. 29/009,674, filed Jun. 17, 1993, now U.S. Pat. No. Des. 356,127 hereby incorporated by reference.

BACKGROUND OF THE INVENTION

Practitioners of the martial arts require extensive practice in the various postures and in the striking of targets either by hand or foot. Typically, a martial arts practitioner would practice against a soft, flexible, kidney-shaped single or double target focus pad held or retained at a particular position from the ground and at a desired angle. The target focus pad is generally held by an instructor or by a fellow practitioner.

It is desirable to provide for a martial arts focus target apparatus where one or particularly multiple focus target pads may be easily and interchangeably positioned at selected heights from the ground and at selected target angles to allow any angle of striking by the user and which permits the training of a beginner or advanced martial arts practitioner in multiple kicking and hand techniques.

SUMMARY OF THE INVENTION

The invention relates to a martial arts focus target apparatus and in particular concerns a multiple, interchangeable, martial arts target apparatus with multiple, angularly adjustable focus pads for practicing hand and foot martial arts striking techniques.

The invention comprises a martial arts target apparatus for use in hand and foot striking of targets by a user, which apparatus comprises a base, a vertically, upwardly extending post secured to the base; and at least one martial arts focus target, which includes a flexible target focus pad means having a one expanded head end or first end to serve as a target focus by a user and an other end or second end, and a target focus pad locking means which comprises a first locking member and a second locking member, the other end of the target focus pad adapted to be placed between and to be grasped in a locking manner by the first and second locking members, adjustable means to secure the locking means between a locking position and an tinlocked position for the replacement of a target focus pad, and locking means to secure the locking means to the post at a desired level and angle to provide for the locked target focus pad to extend generally horizontally outward at a selected angle from the post for use in striking by hand and foot.

The target apparatus has a base and an upright post having a plurality of holes at various levels and about the circumference of the post, to which post may be secured one or more, and typically a plurality, of target focus pads used for martial arts practice. The target focus pads may be single or double pads, usually of soft, stuffed material covered in a flexible plastic and generally balloon, kidney or other shape desired. One narrow end of the kidney focus pad is clampingly secured between two locking members, with the rest of the focus pad projecting outwardly from the locking members or target locks. The target locking means, in one embodiment, are secured by a threaded bolt so that the target focus pad may be easily replaced as desired. In addition, the target locking means are secured also generally by threaded bolts into threaded holes in the post at selected levels and positions.

The holes in the post are dispersed, generally at different levels of height and on different sides of the post, e.g. a square post, so that target focus pads with target locks may be secured at different heights, at different adjustable angles, and on different post sides. Also, the target locks as locking means are adapted for swivel or rotatable movement on the post, so that on loosening and tightening of the post securing bolt, the angle of the target focus pad relative to the post can be easily changed as desired, for example, to place the kidney portion of the pad, upright, downright, or at an angle, with the target lock and pad extending generally horizontally outward from the post. Thus, for example, the target apparatus may hold multiple pads, e.g., 6 to 12 or more, at different heights, post sides and angle positions.

The target apparatus has interchangeable swivel target locks with pads to allow any angle of striking, and the target locks and the pads are easily and quickly changed for multiple height and angle adjustments. The target apparatus may hold one or multiple target focus pads to allow for a variety of striking areas and permits up to four practitioners to train at one time with multiple kicking and hand techniques.

Optionally but preferably, the target apparatus includes a soft, for example, a plastic covered, foam protective pad, adapted to be secured about and over the outward target lock, extended from the post, at the one end of the pad. The pad is wrapped about the extended target lock and extends over a portion of the one end of the clamped focus pad. The protective pad may be releasably secured by various means such as the use of hook and loop velcro-like fasteners, etc.

The invention will be described for the purposes of illustration only in connection with a preferred embodiment, however it is recognized that various changes, modifications, improvements, and additions may be made by those persons skilled in the art to the illustrated embodiment.

BRIEF DESCRIPTION OF THE INVENTION

DESCRIPTION OF THE EMBODIMENTS

Figure 1:
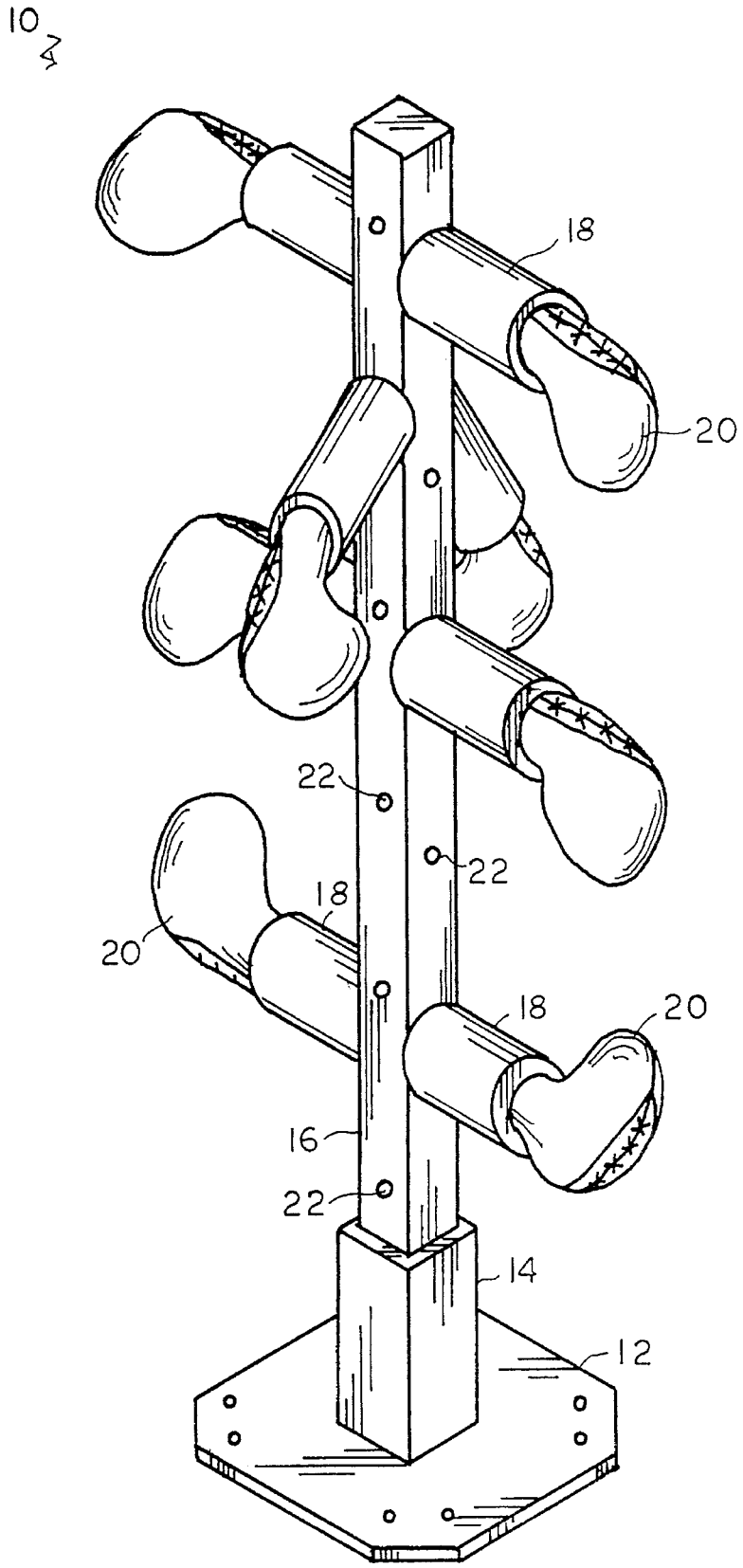
FIG. 1 is a top perspective view from above of the martial arts multiple kicking focus pad holder having a plurality of focus pads.
Figure 2:
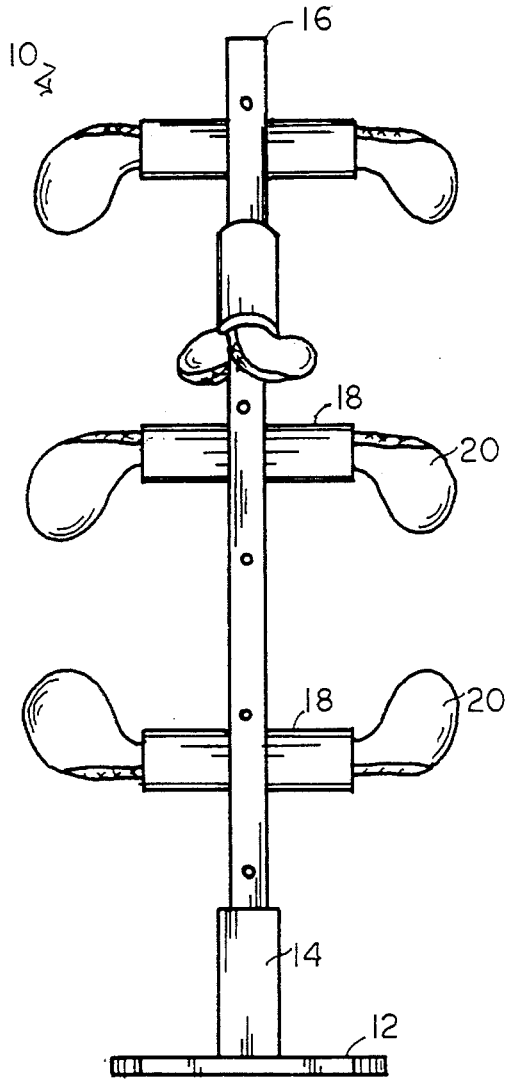
FIG. 2 is a front plan view of the martial arts multiple kicking focus pad holder.
Figure 3:
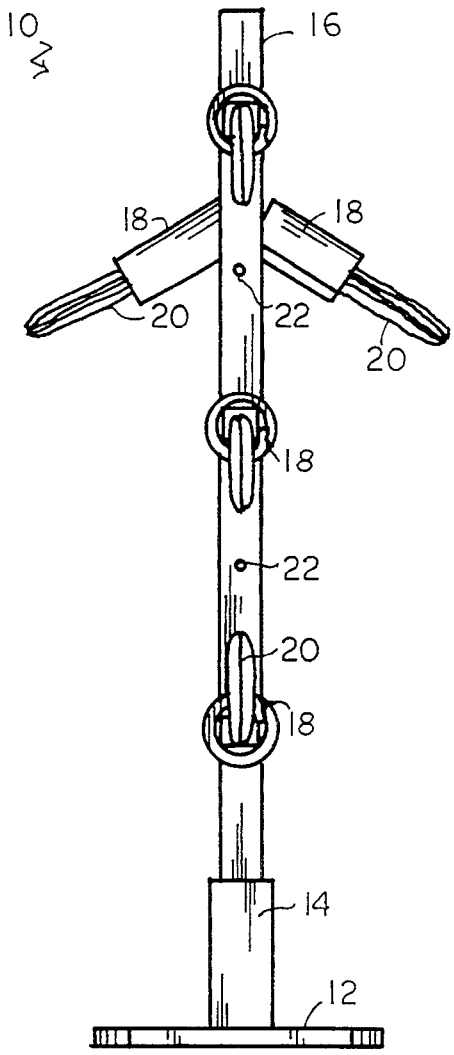
FIG. 3 is a side plan view of the martial arts multiple kicking focus pad holder.
Figure 4:
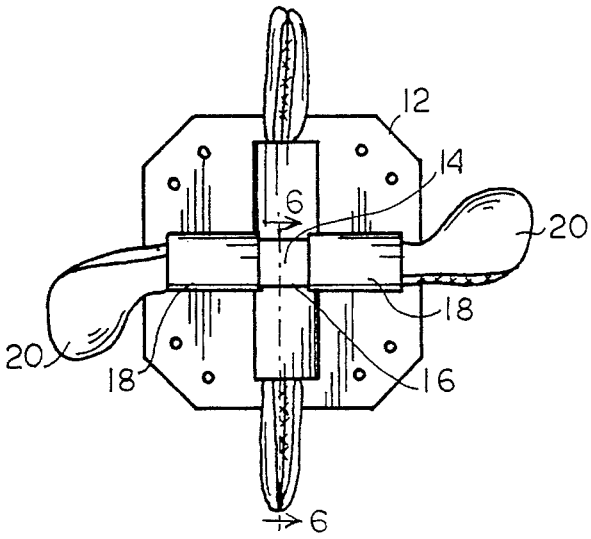
FIG. 4 is a top plan view of the martial arts multiple kicking focus pad holder.

The drawings, FIGS. 1–4, show a target apparatus 10 with a four-sided metal post 16, erected in an upright vertical position within an upright post holder 14 on a flat metal plate base 12. The post 16 includes a plurality of threaded bolt holes 22 with a plurality of kidney-shaped target focus pads 20 doubled over and secured together at the top with a woven rope 24, the one end of the pads 20 and target locks covered with an overlapping, releasable soft foam protective pad 18.

Figure 5:
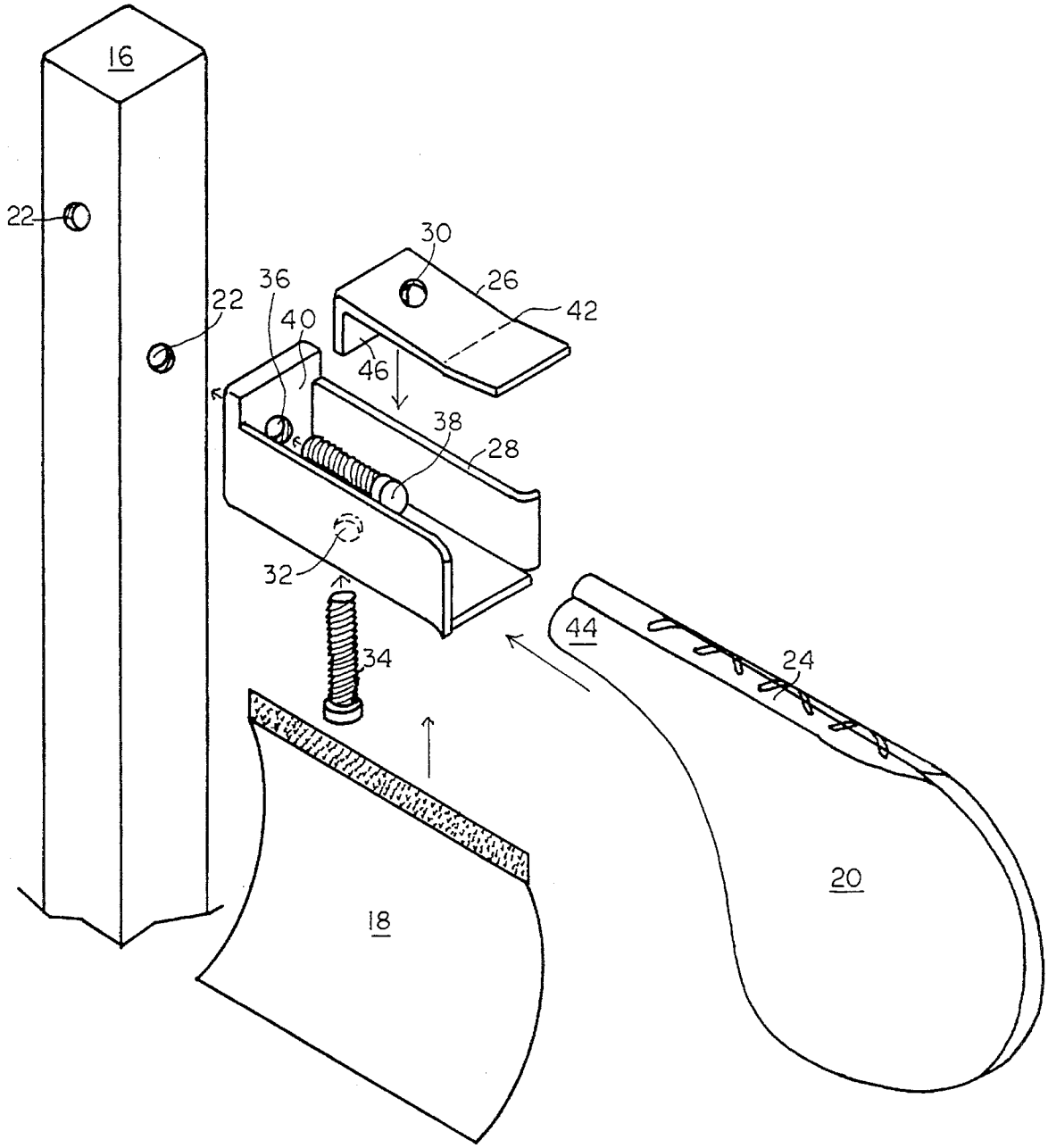
FIG. 5 is a fragmentary, enlarged, exploded perspective view of a portion of the target apparatus.

With particular reference to FIGS. 5 (showing directional arrows regarding part placement) and 6, there is shown a target lock focus pad locking means composed of an upper flat-angled metal plate 26 with a threaded hole 30 and a lower U-shaped, metal, locking member 28 with two sides, an open top, and a base with a bolt hole 32 in the base for a threaded bolt 34 to pass through the hole and to thread into hole 30 of the member 26. The one end, end plate or first end 40 of member 28 has a threaded hole 36. A threaded bolt 38 is threaded through the hole 36 and into post hole 22 to secure the lower member 28 to post 16 at the desired position and pad striking angle.

Figure 6:
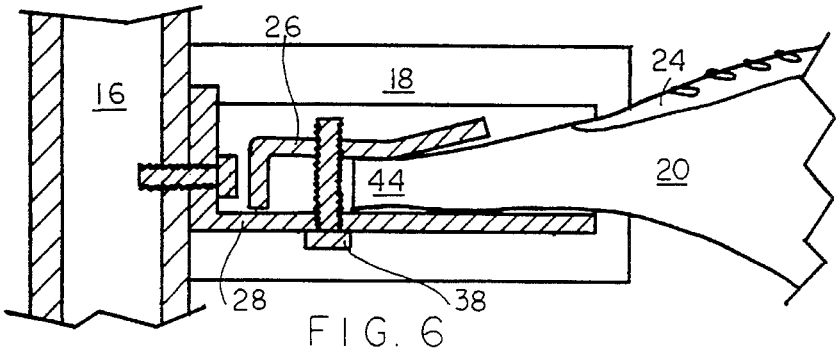
FIG. 6 is a sectional view along lines 6—6 of FIG. 4.

The narrow one end of the target focus pad 20 is inserted between members 26 and 28 and member 26 is secured to member 28 by bolt 34 threaded through the hole 30 on the bottom surface of member 28. Member 26 is angled upwardly to form an angle line 42 at one end and has a downward right angle at the other end or second end 46 with the bolt hole 30 between the one end and the transverse angle line 42 of the member 26, so that on tightening bolt 34 the soft, narrower end 44 of the pad 20 is securely yet flexibly attached within the base of the U-channel of the members 28 and the angle line member 26 (see FIG. 6). The target lock construction permits the one narrow end of the target focus pad 20 to be received easily and effectively secured in an position within the target lock. The target apparatus 10 is illustrated with a number of secured target focus pads 20 at various height levels and angular positions; however, as set forth, the apparatus 10 may include more or less pads 20 of the same or different size or shape and in different height and angular positions.

In use, the one or more focus pads are secured at the other narrow end to the locking means and the locking means and the flexible focus pads secured threadably into the holes of the post at desired heights and on selected sides and angularly adjusted for desired use in practicing of the martial arts.

What is claimed is:

1. A martial arts target apparatus for use in hand and foot striking of focus targets by a user comprising a base for resting on a support surface, a vertically-extending post secured to said base, a flexible focus target pad means having a first end adapted to serve as a focus target by a user and a second end, a focus target pad locking means including a first U-shaped channel locking member having a first end and a second end with an end plate positioned across said first end and configured to be placed against a surface of said vertically extending post and said locking means further including a second locking member, having a length and a width, a first end and a second end said first end of said second locking member being angled in an upwardly turned direction across a line traversing the width of said second locking member, said second locking member being configured in shape and size to fit within the first locking member, means to releasably secure the focus target pad locking means between a locked grasping position and an unlocked position and;

post securing means to secure the locking means at said end plate to said post, wherein when said second end of said focus target pad is lockably receive within said focus target pad locking means said focus pad will extend generally horizontally outward at at a desired angle and height from said post for use in a striking manner by a user's hand or foot.

2. The apparatus of claim 1 wherein said end plate has a hole therein and the post securing means includes a threaded bolt to be inserted through the hole into the post.

3. The apparatus of claim 2 wherein the second locking member includes a threaded hole and the first locking means includes a bolt hole aligned with the threaded hole and the post securing means includes a threaded bolt.

4. The apparatus of claim 1 which includes a threaded bolt means to secure the first and second locking members together in a locking position.

5. The apparatus of claim 1 wherein the focus target pad means comprises a flexible, soft, stuffed, plastic-covered, kidney-shaped pad.

6. The apparatus of claim 5 wherein the focus target pad means includes a pair of adjacent, side-by-side pads connected together along at least one side.

7. The apparatus of claim 1 wherein the post includes a plurality of receiving means for receiving said post securing means.

8. The apparatus of claim 7 wherein the receiving means includes a plurality of spaced apart, threaded holes in the post to receive the post securing means, the threaded holes extending on all sides of the post and distributed generally along the vertical length of the post.

9. The apparatus of claim 1 wherein the second locking means includes a downwardly right-angled extension at said second end.

10. The apparatus of claim 1 wherein the post securing means to secure the locking means to the post comprises a threaded bolt means, and said end plate includes a hole therein to receive the threaded bolt means, wherein the threaded bolt is means adapted to secure the end plate directly to the post.

11. The apparatus of claim 10 wherein the end plate hole comprises a threaded hole and the post includes a threaded post hole, the threaded end plate and post holes adapted to receive the threaded bolt means and to permit the rigid direct attachment of the locking means to the post and to a select angle.

12. The apparatus of claim 1 wherein the post is slidably fitted into and secured to the base.

13. The apparatus of claim 1 which includes a replaceable protective cover means extending generally about the periphery of the locking means.

14. The apparatus of claim 1 which includes a plurality of focus target pad means secured to the post at varying heights and at desired angles.

* * * * *